US008408658B2

(12) United States Patent
Aulisio et al.

(10) Patent No.: US 8,408,658 B2
(45) Date of Patent: Apr. 2, 2013

(54) APPARATUS AND METHOD FOR MINING COAL

(76) Inventors: George Anthony Aulisio, Lakeland, FL (US); Leander Francis Aulisio, Lakeland, FL (US)

( * ) Notice: Subject to any disclaimer, the term of this patent is extended or adjusted under 35 U.S.C. 154(b) by 0 days.

(21) Appl. No.: 13/573,099

(22) Filed: Aug. 21, 2012

(65) Prior Publication Data

US 2012/0319452 A1 Dec. 20, 2012

Related U.S. Application Data

(62) Division of application No. 12/805,703, filed on Aug. 16, 2010, now Pat. No. 8,262,167.

(51) Int. Cl.
*E21C 41/16* (2006.01)

(52) U.S. Cl. ..... 299/18

(58) Field of Classification Search ..... 299/18
See application file for complete search history.

(56) References Cited

U.S. PATENT DOCUMENTS

| | | | | |
|---|---|---|---|---|
| 3,036,821 | A * | 5/1962 | Letts | 299/55 |
| 3,458,235 | A | 7/1969 | Rinio et al. | |
| 3,625,567 | A | 12/1971 | Blumenthal et al. | |
| 3,712,677 | A | 1/1973 | Janssen | |
| 3,797,590 | A | 3/1974 | Archibald et al. | |
| 3,892,442 | A | 7/1975 | Janssen | |
| 3,907,366 | A | 9/1975 | Pender | |
| 3,924,895 | A | 12/1975 | Leasure | |
| 4,200,036 | A * | 4/1980 | Matta et al. | 454/171 |
| 4,305,620 | A | 12/1981 | Hart | |
| 4,330,155 | A * | 5/1982 | Richardson et al. | 299/11 |
| 4,378,132 | A | 3/1983 | Spies et al. | |
| 4,402,371 | A * | 9/1983 | Rocchetti | 175/108 |
| 4,625,631 | A * | 12/1986 | Vera | 454/172 |
| 4,699,429 | A | 10/1987 | Maybrier et al. | |
| 4,753,484 | A | 6/1988 | Stolarczyk et al. | |
| 4,754,142 | A | 6/1988 | Cooper et al. | |

(Continued)

FOREIGN PATENT DOCUMENTS

| | | |
|---|---|---|
| CN | 1053104 | 7/1991 |
| GB | 1414221 | 11/1975 |

OTHER PUBLICATIONS

International Search Report, Apr. 27, 2011, International Application No. PCT/US 11/00270; Applicant: George Anthony Aulisio.

(Continued)

*Primary Examiner* — John Kreck
(74) *Attorney, Agent, or Firm* — Leander F. Aulisio

(57) ABSTRACT

The present invention relates to a novel method of mining underground coal and recovering coal seam gas, the method including locating a seam of coal; digging a mine shaft to reach the seam of coal; constructing a ventilated underground control center which includes a computerized control panel, wherein the computerized control panel controls the movement of a drill head, a hollow drill shaft, a movable hydraulic shield, a movable resin roof bolting machine, and a movable waste extrusion device; providing mining personnel to the ventilated underground control center; and allowing the mining personnel to operate the computerized control panel wherein they perform the tasks of moving the drill head into the seam of coal to obtain aggregate coal and coal seam gas; extruding waste material into mined-out space of the coal seam; and transferring the aggregate coal and coal seam gas to the surface of the earth.

1 Claim, 2 Drawing Sheets

U.S. PATENT DOCUMENTS

| | | | | |
|---|---|---|---|---|
| 5,161,857 | A | 11/1992 | Mayercheck et al. | |
| 5,366,030 | A | 11/1994 | Pool, II et al. | |
| 5,419,405 | A | 5/1995 | Patton | |
| 5,667,279 | A | 9/1997 | Christopher et al. | |
| 5,879,057 | A * | 3/1999 | Schwoebel et al. | 299/17 |
| 6,317,041 | B1 * | 11/2001 | Singer et al. | 340/539.26 |
| 6,612,655 | B2 | 9/2003 | Schwoebel et al. | |
| 6,633,252 | B2 | 10/2003 | Stolarczyk et al. | |
| 6,666,521 | B1 * | 12/2003 | Pease et al. | 299/1.1 |
| 6,688,702 | B1 | 2/2004 | Abramov et al. | |
| 6,755,480 | B2 | 6/2004 | Sult et al. | |
| 6,791,469 | B1 | 9/2004 | Rao et al. | |
| 7,207,632 | B2 | 4/2007 | Lowery | |
| 2002/0113484 | A1 | 8/2002 | Schwoebel et al. | |
| 2002/0185906 | A1 | 12/2002 | Stolarczyk | |
| 2003/0131989 | A1 | 7/2003 | Zakiewicz | |
| 2003/0201098 | A1 | 10/2003 | Karanikas et al. | |
| 2004/0033557 | A1 | 2/2004 | Scott et al. | |
| 2004/0070257 | A1 | 4/2004 | Drake et al. | |
| 2005/0013672 | A1 | 1/2005 | Slater | |
| 2005/0067879 | A1 | 3/2005 | Burgess et al. | |
| 2005/0103527 | A1 | 5/2005 | Church et al. | |
| 2006/0005972 | A1 | 1/2006 | Rusby et al. | |
| 2006/0248875 | A1 | 11/2006 | Maganas | |
| 2009/0133730 | A1 | 5/2009 | McVey | |

OTHER PUBLICATIONS

Holman, Darren W., "Development of an Underground Automated Thin-Seam Mining Method," Thesis submitted to Faculty of the Virginia Polytechnic Institute and State University.

* cited by examiner

APPARATUS AND METHOD FOR MINING COAL

The present application is based on U.S. patent application Ser. No. 12/805,703, filed on Aug. 16, 2010, now U.S. Pat. No. 8,262,167; which is based on Provisional U.S. Patent Application Ser. No. 61/272,142, filed on Aug. 20, 2009.

BACKGROUND OF THE INVENTION

The present invention is dedicated to Georgio Aulisio. He boarded ship from his native Italy and arrived at Ellis Island in the Harbor of New York City in the late $19^{th}$ century at the age of sixteen. He had six dollars in his pocket. During his lifetime, he was employed in the anthracite coal mines of eastern Pennsylvania.

Prior art methods of mining coal include surface mining and underground mining. In surface mining, a seam of coal located close to the surface of the earth is first exposed by mechanical removal of the earth above the coal seam. A mountaintop, for example, can be removed by employing bulldozers and earthmoving equipment to expose an underground seam of coal. The exposed seam of coal is mined by employing machinery known to one of ordinary skill in the art.

Underground mining includes sinking a shaft into the earth near (or into) a seam of coal. A ventilated area is then constructed within the seam of coal. Ventilation of the underground area allows coal miners to operate mechanical equipment at the face of a coal seam. The coal is then brought to the surface. A preferred method of removing coal from the coal face is the long-wall method of mining. Regardless of the method employed in underground mining, conditions for the miners are very dangerous. Although various safety precautions are taken with regard to the underground mining of coal, accidents occur on a regular basis.

One problem in underground mining of coal is the presence of methane gas in the coal seam. A coal seam is naturally infused with substantial amounts of methane. Methane is the most highly reduced form of carbon, which means that it readily undergoes rapid oxidation. It forms an explosive mixture with oxygen (air). Methane has an upper explosive limit and a lower explosive limit. The upper explosive limit (UEL) for methane is about 15% by volume. The lower explosive limit (LEL) for methane is about 5% by volume. Traditional underground mining operates in a region below the lower explosive limit of methane. Conditions in an underground mine can be monitored by employing a "bug lamp". The "bug lamp" burns with a bright yellow flame when the composition of the atmosphere at the face of a coal seam is such that it is below the LEL of methane. When the "bug lamp" burns with a blue cap above the yellow flame, the underground atmosphere is above the LEL of methane. This signifies extremely dangerous conditions. Ventilation with above-ground air is immediately increased to remove the dangerous conditions. Mining operations cease when the atmospheric condition in the underground mine is above the LEL of methane.

SUMMARY OF THE INVENTION

The present invention relates to a novel method for mining underground coal. The earth is not stripped away from the coal seam. The method comprises mining of underground coal that is deep within the crust of the earth. Coal seams as deep as a half mile or more can be mined by employing the method of the present invention. The hazards of traditional underground mining, such as the long-wall method of mining coal, are substantially reduced or even eliminated. A safe and efficient method of mining underground coal, preferably coal that is located deep underground, is hereby disclosed.

In an embodiment, the present method includes locating a seam of coal under the surface of the earth, and sinking a main shaft within the seam of coal. An underground control center is then constructed adjacent to the main shaft. The underground control center is within the seam of coal. The underground control center can be a box-like, rectangular shaped structure. In order to ventilate the underground control center, a ventilation system is constructed. The ventilation system includes a ventilation unit, a ventilation fan and a ventilation shaft. The ventilation fan is located on the surface of the earth. The ventilation unit is located inside the underground control center, and supplies fresh air from the ventilation fan to the underground control center. The ventilation shaft connects the above-ground ventilation fan with the underground ventilation unit. The ventilation shaft contains a first passageway and a second passageway. The first passageway supplies fresh air from above the ground to the underground control center; and the second passageway removes polluted air from the underground control center and releases it to the atmosphere above the ground. If the underground control center is in the shape of a box-like, rectangular unit, then the rectangular unit can have dimensions such as 150 feet long, 120 feet wide and 30 feet high.

The underground control center contains a computerized control panel. The computerized control panel is operatively connected to a first power source and a second power source. Two types of power that can be employed in the underground setting of the coal mine are hydraulic power and electric power. The first power source is further connected to a drill head. The second power source is further connected to a movable hydraulic shield and a movable waste extrusion unit. Electric wires or electric cables can be employed as the electrical connections between the computerized control panel and the various pieces of movable equipment such as the movable hydraulic shield and the movable waste extrusion unit. The drill head is operatively connected to the first power source by a hollow, extendable drill shaft. The hollow drill shaft allows mined coal to pass through the shaft and ultimately be collected at the surface of the earth. In an embodiment, mined coal passes through a mesh filter to discard larger pieces of coal before entering the hollow drill shaft. Preferably, the mesh filter is located directly behind the drill head. After discarding larger pieces of coal, a fluid is added to the remaining coal to obtain coal particles suspended in a dispersion or slurry. A pump is employed to move the coal dispersion or slurry through the hollow drill shaft and toward the underground control center. The pump is operatively connected to the computerized control panel. In an embodiment, the pump is located within the underground control center. The slurry is passed through the hollow, extendable drill shaft in the opposite direction of the advancing drill head. Depending on the speed of advance of the drill head, the pumping operation can be continuous or intermittent. When the pumping operation allows flow of dispersed coal particles at a speed faster than that of the advancing drill head, then the pumping operation can be continuous. Otherwise, the drilling operation is stopped, and the pumping of the coal particles occurs in a discontinuous fashion. Mining personnel in the underground control center operate the computerized control panel to both advance the drill head into the coal seam and advance the coal dispersion or slurry toward the underground control center. The control center also functions as a storage room for all of the needed mining equipment such as extendable pipes, drill heads, extrusion units, connection devices, electrical units, electrical cables and wires, roof bolts, hydraulic shields, resin roof bolting machines, maintenance equipment and the like. Apparatus that follows behind the advancing drill head in the coal seam is herein referred to as "movable equipment". Movable equipment comprises a movable hydraulic shield, a movable resin roof bolting machine, and a movable waste extrusion unit. In an embodiment, the movable pieces of equipment, such as the movable hydraulic shield, the movable resin roof bolting machine and the movable waste extrusion unit, can employ the hollow, extendable drill shaft as a "track" to control the direction of their forward progress. The movable extrusion unit allows mining personnel in the underground control center to fill the void space of the coal seam (the mined-out volume of the coal seam) with used rubber tires and other types of waste. This filling of the void space also has the advantage of preventing subsidence in the mine.

DETAILED DESCRIPTION OF THE INVENTION

Figure 1:
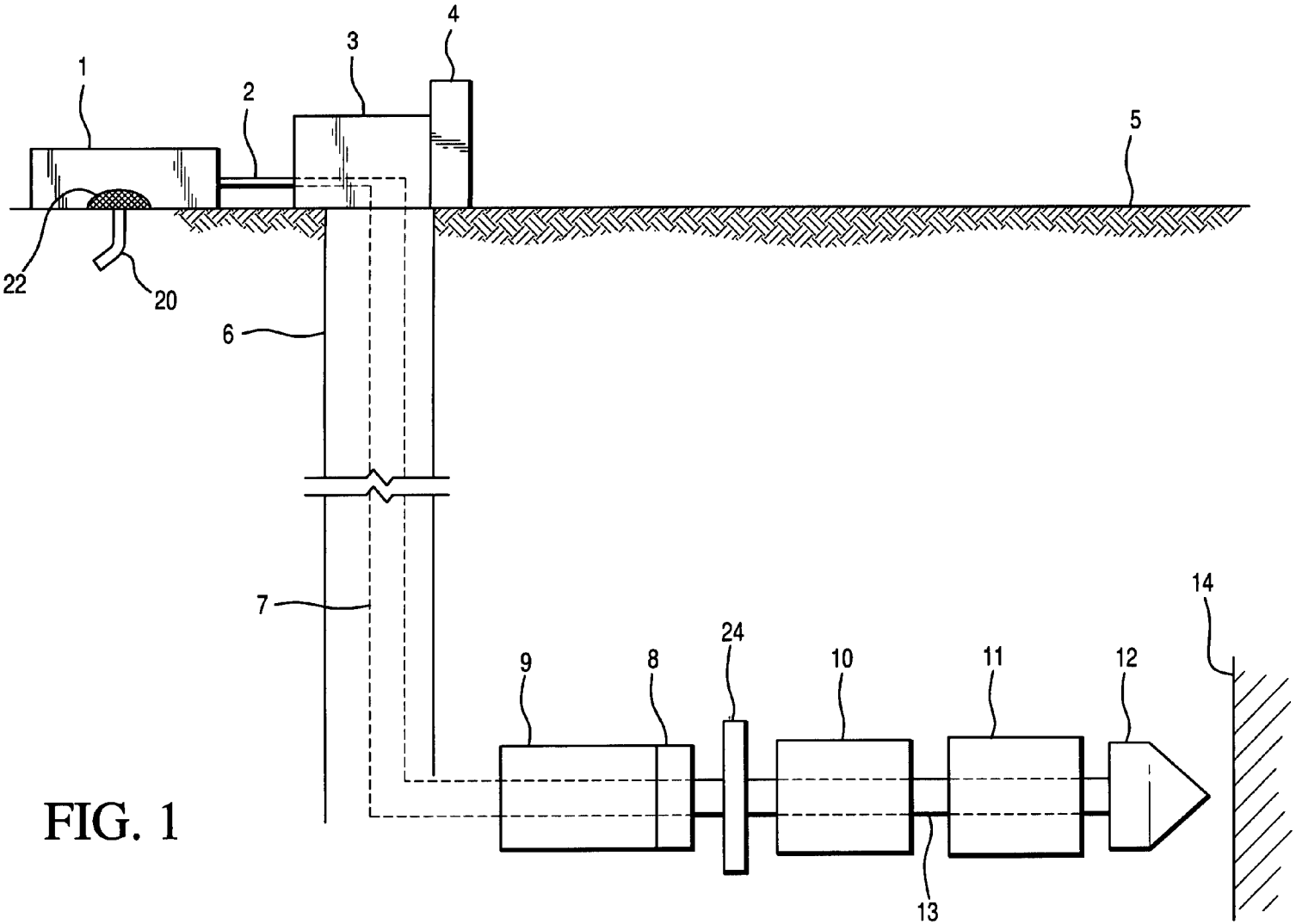
FIG. 1 is a representation of an embodiment of the present invention wherein an underground operations center is employed to mine coal in a robotic fashion.

There are many seams of coal located within the crust of the earth. The coal seams can be very deep within the crust. The geological construct of the crust can be represented as a compilation of layers of materials, one on top of the other. Within the center of the earth is hot liquid magma. Surrounding the center of hot magma is the crust. Within the crust, coal seams alternate with layers of rock and the like. It is not uncommon for coal seams to be located one above the other, with a layer of rock in between any two seams. For example, in the Western Pennsylvania/West Virginia region of the United States of America, coal mining operations have been conducted in a seam of coal known as "Pittsburgh #8". This means that there are seven seams of coal above the "Pittsburgh #8" seam. Seams of coal are also located below "Pittsburgh #8".

Coal seams are designated as "high seam" coal or "low seam" coal. "Low seam" coal is usually about a few inches in depth to about eight feet in depth. High seam coal is greater than about eight feet to about fifty-five feet in depth, or even deeper. By "depth" of the coal seam is meant the distance from the top of the seam of coal to the bottom of the seam of coal. The present invention can be employed to mine both "high seam" coal and "low seam" coal. The method of the present invention can be employed to mine "rooster" coal, which can have a depth of only about a few inches up to about a few feet.

Coal seams are located by means of well-known geological surveying methods. Methods of location of underground seams of coal are well-known in the art and, as such, form no part of the present invention. It is to be understood that location of specific seams of coal can be readily accomplished, and, as such, form no barrier to the practice of methods of the present invention.

In an embodiment, the method of the present invention includes locating a seam of coal under the surface of the earth, and sinking a main shaft substantially within the seam of coal. An underground control center is then constructed substantially adjacent to the mine shaft and within the seam of coal. The control center comprises a ceiling section, a plurality of walls depending from the ceiling section and a floor section for receiving the walls. Roof bolts are employed to stabilize the ceiling section of the control center. Any number of walls can be used, thus giving various shapes to the control center. Preferably four walls are employed. In an embodiment, the underground control center is rectangular in shape.

A ventilation system containing a ventilation unit, a ventilation fan and a ventilation shaft is employed to ventilate the underground control center. The ventilation fan is located on the surface of the earth. The ventilation unit is located inside the underground control center, and supplies fresh air to the underground control center. The unit also removes stale air from the control center. The ventilation shaft connects the above-ground ventilation fan with the underground ventilation unit. In an embodiment of the present invention, the ventilation shaft is constructed such that it is substantially parallel with the main shaft. The ventilation shaft supplies fresh air from above ground to the underground control center. The ventilation fan drives air from above the ground into the ventilation shaft. In an embodiment, the ventilation shaft contains a first passageway and a second passageway. The first passageway supplies fresh air from above the ground to the underground control center. The second passageway removes polluted air from the underground control center. The ventilation system of the present invention is substantially smaller than ventilation systems of all prior art underground mining operations. This is because the coal face is not ventilated. Only the underground control center is ventilated with breathable air.

Mining personnel reach the underground control center by means of an elevator system that is located within the main shaft. The number of underground mining personnel is greatly reduced in the present invention. Preferably, less than ten personnel are employed in the method of the present invention. More preferably, about four or five mining personnel are employed. Most preferably, one or two mining personnel occupy the underground control center. Mining personnel occupying the underground control center perform tasks, such as mining coal and extruding waste, in an extremely safe underground environment.

The underground control center contains a computerized control panel. The control panel is operatively connected to a first power source and a second power source. A drill head is operatively connected to the first power source by means of a hollow, extendable drill shaft. In an embodiment, the drill head is a tri-cone drill head. The first power source is an electric motor, a jet engine, a fuel cell or a combustion engine. The first power source drives the drill head into the underground seam of coal. In an embodiment, coal is collected at a collection zone located immediately behind the advancing drill head. The collection zone directs aggregate coal into the hollow drill shaft for transfer to the underground control center, and eventually to the coal collection unit located above-ground. In an alternative embodiment, the rotating drill head contains a hollow passageway in the center of the drill head. Aggregate coal is drawn into the hollow passageway. From the hollow passageway in the advancing, rotating drill head, the mined coal enters the hollow, extendable drill shaft for transfer to the underground control center, and eventually to the coal collection unit located above-ground.

In an embodiment, the drill head rotates at a speed that is faster than the rotational speed of cutting blades of traditional mining operations. In prior art methods of mining underground coal, the cutting machines operate at a relatively slow speed, almost like a grinding speed. The rotational speed of the drill head in the present invention is about 500 rpm to about 5000 rpm, or even higher. It is within the scope of the present invention to mine coal as quickly as possible by shooting the drill head through the seam of coal. In an embodiment of the present invention, this "high speed coal mining" can be accomplished by employing a jet engine as the first power source. Mining of the underground coal seam proceeds in an extremely safe environment because the actual mining operation is conducted in an underground atmosphere that is substantially above the UEL for methane.

In an alternative embodiment, the drill head is replaced by a "hot head" device that can burn through the coal seam. A "hot head" is presently defined as a piece of machinery that "burns" the coal from the coal seam. Coal is vaporized at the face of the coal seam. Vaporized coal is then readily pumped to the surface of the earth for further transport. A machine for vaporizing the coal, herein referred to as a "hot head" device is well known to one of ordinary skill in the art and, as such, forms no part of the present invention. It is within the scope of the present invention to employ a combination of drill head(s) and "hot head" device(s).

Coal mined by the drill head is passed through a mesh filter to discard larger pieces of coal. In an embodiment, the mesh filter is located at the distal part of the extendable, hollow drill shaft, and immediately behind the drill head. The extendable, hollow drill shaft has a proximal end, located within the underground control center; and a distal end, located immediately behind the drill head. The distal end is farthest from the underground control center. In an embodiment, the mesh filter has a mesh size that rejects coal pieces larger than about ½ inch in diameter. In an alternative embodiment, the mesh filter has a mesh size that rejects coal pieces larger than about 12 inches in diameter. A mesh size anywhere within the range of about ½ inch to about 12 inches is acceptable. It is within the scope of the present invention to employ more than one mesh filter at the distal end of the extendable, hollow drill shaft. It is also within the scope of the present invention to operate without the use of such a mesh filter; as the mining action alone of the advancing drill head, under various circumstances, crushes the coal particles to a size adequate for slurry transport.

In an embodiment, the pieces of coal are combined with a fluid. The fluid can be any material, liquid or gas, used for transporting particles of coal. The mixture of coal and fluid forms a dispersion or slurry of coal particles. In an embodiment, the fluid is water. In another embodiment, the fluid is air. The dispersion or slurry is pumped through the extendable, hollow drill shaft towards the underground control center. When the slurry reaches the underground control center, it is transported to the surface of the earth. A pump or a series of pumps allows the coal particles to be transported to the surface of the earth.

In an embodiment, a directing means for advancing the drill head in a desired direction is employed. The directing means allows the drill head to stay within the coal seam as the drill head cuts a substantially circular hole in the seam. The directing means also avoids the possibility of the drill head cutting through rock or other geological material. The directing means is operatively connected to the computerized control panel in the underground control center. In an embodiment, the directing means is located directly behind the advancing drill head. A directing means is known to one of ordinary skill in the art, and, as such, forms no part of the present invention.

In an embodiment, the directing means comprises an optical fiber. The optical fiber allows mining personnel in the underground control center to monitor the progress of the drill head. It also allows the mining personnel to adjust the forward direction of the drill head, providing a favorable path through the crust of the earth.

The hollow, extendable drill shaft allows aggregate coal (the mined coal) to be removed from the coal face and transferred to the surface of the earth. The mined coal is then removed to an above-ground collection unit.

Mining personnel in the underground control center operate the computerized control panel to control the drill head and mine coal. The first power source that drives the drill head and advances it through a coal seam is an electric motor, a combustion engine, a fuel cell, or a jet engine. In a preferred embodiment, the first power source is a jet engine. Mining personnel working in the underground control center are protected from the severe noise of the jet engine by sound-proofing means such as a noise barrier for sound control. Sound-proofing means are known to one of ordinary skill in the art, and, as such, form no part of the present invention.

A stationary first hydraulic shield is placed between the underground control center and the face of the coal seam. In a preferred embodiment, the first hydraulic shield is located at a position about five feet to about twenty feet in front of the underground control center. By the "front" of the underground control center is meant the side of the control center that faces the advancing drill head(s). It is within the scope of the present invention to have multiple "fronts" for the underground control center, as multiple drill heads can be advancing outwardly in a radial fashion from one underground control center. The stationary first hydraulic shield protects the operations center from various materials either employed or generated during the mining operation. The materials can be liquids, solids or gases. Examples of such materials are methane, slurry water, cooling water for the drill head(s), carbon monoxide and large pieces of coal and rock. The stationary first hydraulic shield remains in place during the entire mining operation. Hydraulic shields are known to one of ordinary skill in the art and, as such, form no part of the present invention.

A second hydraulic shield is movable. By "movable" is meant that the shield advances behind the drill head. It stabilizes the drilling area. The second hydraulic shield also assists in supporting the roof bolts that are placed in the roof of the mine. By "mine" is meant the substantially circular opening that is formed by the advancing drill head. The second hydraulic shield also stabilizes the drill head. Further, the second hydraulic shield acts as an effective barrier against methane. In an alternative embodiment, a plurality of movable hydraulic shields is employed. Preferably, three to four movable hydraulic shields are employed to further protect the operations center from methane gas and the like.

A movable resin roof bolting machine is placed between the drill head and the underground control center. By "movable" is meant that the resin roof bolting machine advances behind the drill head. The resin roof bolting machine stabilizes the mined out area behind the advancing drill head. The resin roof bolting machine, in a first step, applies resin to the roof of the mined out section of the coal seam. By "mined out section" is meant the substantially circular opening that is formed by the advancing drill head. The movable resin roof bolting machine, in a second step, sinks roof bolts into the resin-coated coal. The roof of the mine (mined out section) is thus stabilized. The movable resin roof bolting machine contains at least one drill which drives bolts into the roof of the mine behind the advancing drill head.

In an embodiment, the order of equipment advancing through the coal seam is: drill head, resin roof bolting machine and second movable hydraulic shield. In an alternative embodiment, the order of advancing equipment is: drill head, second movable hydraulic shield and resin roof bolting machine.

In an embodiment, mining personnel in the underground control center operate the computerized control panel to advance the drill head and the movable equipment through the coal seam.

In an embodiment, an extrusion system is employed. The extrusion system contains an above-ground waste disposal unit, a hollow transfer pipe and a movable extrusion device. The extrusion device is located underground and is connected to the above-ground waste disposal unit by the hollow transfer pipe. It advances behind the movable resin roof bolting machine, the movable second hydraulic shield and the drill head. The movable extrusion device is operatively connected to the second power source wherein the second power source is operatively connected to the computerized control panel. In an embodiment, the extrusion device is connected to the second power source by electrical means. Electrical means are electric wires and electric cables. By operating the computerized control panel, mining personnel control the advancement of the movable extrusion device. In an embodiment, the movable extrusion device can employ the hollow, extendable drill shaft as a "track" to control the direction of the forward progress of the extrusion device.

In an embodiment, the above-ground waste disposal unit is located at a proximal distance to the entrance of the main shaft. By "proximal distance" is meant a distance up to about a hundred yards. Waste material is deposited in the waste disposal unit. Waste material can be bio-medical waste, used tires, landfill waste, slaughterhouse waste, municipal waste, low grade nuclear waste or mixtures thereof. In a preferred embodiment, the waste is discarded rubber tires. The waste disposal unit optionally contains a compaction device for compacting waste material.

In an embodiment, discarded rubber tires are sheared before they are deposited into the above-ground waste disposal unit. A shearing device is located adjacent to the waste disposal unit. The shearing device is employed to shear the discarded rubber tires. The sheared tires are transported from the above-ground waste disposal unit, through the hollow transfer pipe to the underground movable extrusion device. Shearing devices are known to one of ordinary skill in the art and, as such, form no part of the present invention.

In an alternative embodiment, the shearing device is located in the underground control center. Discarded tires are transported from the above-ground waste disposal unit to the underground shearing device by means of the hollow transfer pipe. Once under the ground, the discarded tires are sheared. They are transported to the movable extrusion device by a transfer means. The transfer means can be a movable belt assembly, a hollow conduit, a spray gun or the like.

In an embodiment, the movable extrusion device is filled with sheared tires or the like prior to the drilling operation. The extrusion device is stationary while it is being filled. In an alternative embodiment, the extrusion device is continuously filled with sheared tires and the like while it advances behind the train of movable equipment, which includes the drill head, the second hydraulic shield and the resin roof bolting machine. Preferably, a hollow conduit is employed to fill the advancing extrusion device.

In an embodiment, coal is mined outwardly in a radial fashion from an underground control center in multiple directions. A plurality of drill heads is employed for the mining of underground coal in multiple directions.

In an alternative embodiment, coal is mined from the underground control center in only one direction, but with a plurality of drill heads. Each drill head is operatively connected to a hollow, extendable drill shaft. Further, each drill head advances through the seam of coal, mining the coal with each advance, in unison with at least one movable hydraulic shield, at least one movable resin roof bolting machine and at least one movable extrusion device. Preferably, the number of drill heads is about two to about eight. Most preferably, the number of drill heads is three. Various formations are possible for the advancing drill heads, such as a linear array in a vertical or horizontal pattern.

In an embodiment, the drill head penetrates into the seam of coal for a distance of about a quarter mile to about three miles, or even longer. Penetration range is limited only by the mechanical constraints of the mining equipment.

The present invention further relates to a method of reclaiming land that is a land-fill or the like. Surface area on the earth (real estate) is a valuable commodity. As such, it can be reclaimed and used for such commercial enterprises as homebuilding, commercial building construction, farmland, nuclear power plants, wind farms, solar energy plants and the like. By employing methods of the present invention, a large amount or all of the land now used for storing municipal waste in landfills can be recovered for more productive use by removal of the waste material to mined-out regions. Preferably, the mined-out regions are deep within the crust of the earth to avoid problems with pollution of underground water. Automobile junkyards and the like can also be converted to useful property by employing methods of the present invention.

Referring to FIG. 1, a schematic diagram of an underground coal mining operation of the present invention is presented. A coal collection unit 1 is located on the surface of the earth 5. The coal collection unit 1 receives the coal that is mined by the operation. The coal is usually in the form of particles ranging in size from about a few inches in diameter up to about one foot in diameter. If the coal is pulverized, the particles are much less than a few inches in diameter. The above-ground coal collection unit 1 receives the particles of coal dispersed in a slurry. It is within the scope of the present invention to locate at least one drainage ditch 20 in the bottom of the coal collection unit 1. The at least one drainage ditch 20 allows water from the slurry to be removed from the coal particles. The drainage ditch 20 is covered with a fine mesh screen 22. The fine mesh screen 22 prevents particles of coal, including very fine particles of coal, from leaving the coal collection unit 1. Coal removed from underground coal seam 14 is transported through the drill head 12 or behind the drill head 12 and into a slurry unit (not shown). In the slurry unit (not shown), the mined coal is combined with a fluid such as water or gas to form a coal slurry. The coal slurry is removed to the hollow, extendable, rotatable drill shaft 13. From the drill shaft the coal slurry enters the coal slurry pipe 7. The coal slurry is pumped to the surface of the earth, where it passes into the coal slurry pump house 3. Transfer means 2 leads the coal slurry from the coal slurry pump house 3 to the coal collection unit 1.

The coal slurry pump house 3 receives coal slurry from the coal slurry pipe 7. The coal slurry pump house 3 contains at least one pump (not shown). The at least one pump (not shown) draws out the coal slurry from underground by pumping action. The coal slurry pipe 7 transfers the coal slurry from underground to above-ground. Coal slurry pipe 7 is located within a main shaft 6. The main shaft 6 is positioned between the coal slurry pump house 3 and an underground control center 9. The coal slurry travels a recovery path that leads from the coal face 14 to the coal collection unit 1.

A ventilation fan 4 is located above the ground. The ventilation fan 4 removes stale air from the underground control center 9. The ventilation fan 4 also draws fresh air from the atmosphere above the surface 5. Fresh air is then transferred from the above-ground atmosphere to the underground control center 9 by means of a ventilation shaft (not shown). The fresh air is distributed by means of a ventilation unit (not shown) located in the underground control center, allowing mining personnel to work in a safe environment.

A power source 8 drives a drill head 12. In an embodiment, the drill head 12 is a tri-cone drill. The tri-cone drill is useful in both the mining of the coal and in reducing the particle size of the coal. In an embodiment of the present invention, the drill head 12 is hollow in a central portion thereof. This feature of the drill head 12 allows mined coal to be removed to the extendable, hollow drill shaft 13 for transport to the surface of the earth. The drill head 12 is operatively connected to the power source 8 by extendable, rotatable, hollow drill shaft 13. By "extendable" is meant that hollow pieces can be added from the underground control center to the lengthening drill shaft 13, similar to an oil drilling operation.

The drill head 12 bites into a coal seam 14 to mine coal. The drill shaft 13 is a hollow shaft. This allows the mined coal, also known as aggregate coal, to be transferred to the underground control center 9. A first stationary hydraulic shield 24 is located adjacent to the underground control center 9 and the power source 8. A second movable hydraulic shield 11 is located substantially immediately behind the drill head 12. The second movable hydraulic shield 11 follows behind the advancing drill head 12. The second hydraulic shield 11 contains a methane barrier for preventing methane gas from penetrating into the underground control center 9.

In an embodiment, the power source 8 contains a jet engine. The jet engine drives the drill head 12 into the underground coal seam 14 in substantially less time than a standard combustion engine or the like.

A roof resin bolting machine 10 is movable. It travels behind the advancing second hydraulic shield 11. The roof resin bolting machine 10 comprises at least one drill. The drill bolts the roof of the mine. In the bolting operation, a resin composition is first deposited on the overhead surface of the drilled out coal seam. In an embodiment, the drilled out (mined out) coal seam is substantially circular. When viewed in a three dimensional Cartesian space, the mined out area of the coal seam is in the shape of a cylinder. Bolts are then deposited into the resin composition. Finally, the bolts are drilled into the roof of the coal seam. This series of operations prevents collapse of the mine by stabilizing the mined out coal seam.

In an alternative embodiment, the drill head 12 is a high temperature drill head (a "hot head" machine) that gasifies the coal as it is being mined. Such technology is known to one of ordinary skill in the art, and as such forms no part of the present invention. The gasified coal is then readily transported to the surface for storage and ultimate transport.

In an alternative embodiment, the drill head 12 can be operated at a temperature that liquefies the coal as it is being mined. Liquefied coal is then readily removed to the surface for storage and ultimate transport.

Figure 2:
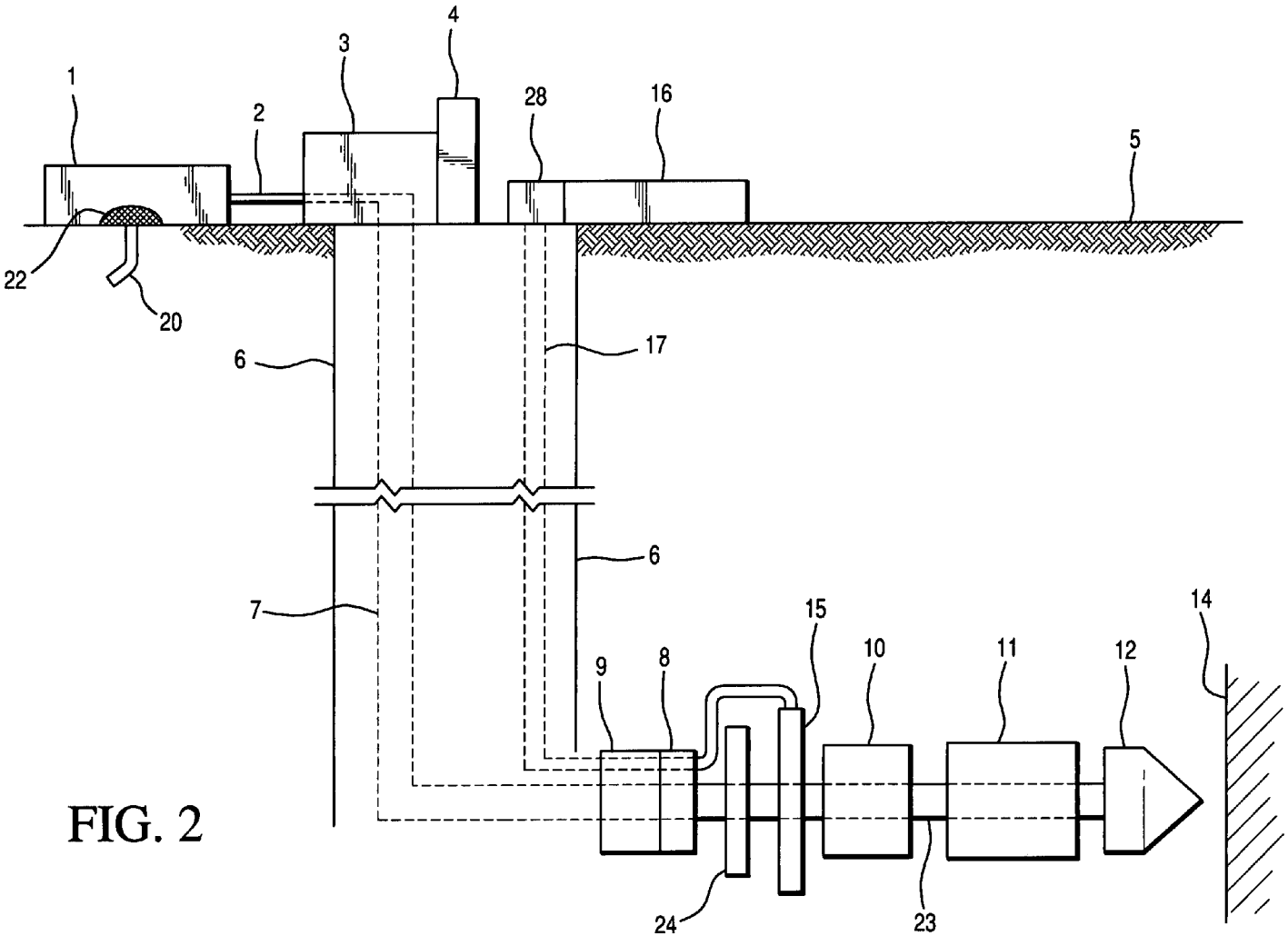
FIG. 2 is a representation of an embodiment of the present invention wherein an extrusion unit fills a mined out section of a coal seam with waste material in a robotic fashion.

Referring to FIG. 2, a schematic diagram of an underground coal mining operation of the present invention, including a waste extrusion system, is presented. A coal collection unit 1 is located on the surface of the earth 5. The coal collection unit 1 receives the coal that is mined. The coal is preferably in the form of particles ranging in size from about a few inches in diameter up to about one foot in diameter. If the coal is pulverized, the particles are much less than a few inches in diameter. The coal collection unit 1 receives the particles of coal in a slurry. The coal travels from underground to above-ground in the coal slurry pipe 7.

A drainage ditch 20 is located in the bottom of the coal collection unit 1. The drainage ditch 20 allows water from the slurry to be removed from the coal particles. The drainage ditch 20 is covered with a fine mesh screen 22. The fine mesh screen 22 prevents particles of coal, including very fine particles of coal, from leaving the coal collection unit 1. Coal removed from underground coal seam 14 is transported through the drill head 12 or behind the drill head 12 and into a slurry unit (not shown). In the slurry unit (not shown), the mined coal is combined with a fluid such as water or the like to form a coal slurry. The coal slurry is removed to the transfer pipe 13 and brought to the surface where it passes through the coal slurry pump house 3. Transfer means 2 leads the coal slurry from the coal slurry pump house 3 to the coal collection unit 1.

A ventilation fan 4 is located above the ground. The ventilation fan 4 removes stale air from the underground control center 9. The ventilation fan 4 also draws fresh air from the atmosphere above the surface 5. Fresh air is then transferred from the above-ground atmosphere to the underground control center 9 by means of a ventilation shaft (not shown). This fresh air is distributed by means of a ventilation unit (not shown) located in the underground control center, allowing mining personnel to work in a safe environment.

A power source 8 drives a drill head 12. In an embodiment, the drill head 12 is a tri-cone drill. The tri-cone drill is useful in both the mining of the coal and in reducing the particle size of the coal. In an embodiment of the present invention, the drill head 12 is hollow in a central portion thereof. This feature allows mined coal to be removed to the extendable, hollow drill shaft 13 for transport to the surface of the earth. The drill head 12 is operatively connected to the power source 8 by extendable, rotatable, hollow drill shaft 13. By "extendable" is meant that hollow pieces can be added from the underground control center to the lengthening drill shaft 13, similar to an oil drilling operation.

The drill head 12 bites into a coal seam 14 to mine coal. The drill shaft 13 is a hollow shaft. This allows the mined coal, also known as aggregate coal, to be transferred to the underground control center 9. A first stationary hydraulic shield 24 is located adjacent to the underground control center 9 and the power source 8. A second movable hydraulic shield 11 is located immediately behind the drill head 12. The second movable hydraulic shield 11 follows behind the advancing drill head 12. The second hydraulic shield 11 contains a methane barrier for preventing methane gas from penetrating into the underground control center 9.

In an embodiment, the power source 8 comprises a jet engine. The jet engine drives the drill head 12 into the underground coal seam 14 in less time than a standard combustion engine or the like.

A roof resin bolting machine 10 is movable. It travels behind the advancing second hydraulic shield 11. In an embodiment, the drilled out (mined out) coal seam is substantially circular. When viewed in a three dimensional Cartesian space, the mined out area of the coal seam is in the shape of a cylinder. The roof resin bolting machine 10 comprises at least one drill. The drill serves to bolt the roof of the mine. A resin composition is first deposited on the overhead surface of the drilled out coal seam. Bolts are then deposited into the resin composition. Finally, the bolts are drilled into the coal seam. This series of operations prevents collapse of the mine because it stabilizes the mined out coal seam. The operations of depositing resin, adding bolts to the resin, and drilling the bolts into the resin-coated roof of the mine are performed by mining personnel in the underground control center, wherein the computerized control center is employed to perform the operations.

In an alternative embodiment, the drill head 12 is a high temperature drill head (a "hot head" machine) that gasifies the coal as it is being mined. Such technology is known to one of ordinary skill in the art, and as such forms no part of the present invention. The gasified coal is then readily transported to the surface for storage and ultimate transport.

In an alternative embodiment, the drill head 12 can be operated at a temperature that liquefies the coal as it is being mined. Liquefied coal is then readily removed to the surface for storage and ultimate transport.

A movable extrusion device 15 is located behind the roof resin bolting machine 10. The extrusion device 15 is filled with disposable waste which is a member selected from the group consisting of biomedical waste, discarded rubber tires, landfill waste, slaughterhouse waste, municipal waste, low grade nuclear waste and mixtures thereof. In an embodiment, the waste is discarded rubber tires. In a preferred embodiment, the waste is discarded rubber tires that have been sheared or shredded. The shearing or shredding of the tires is conducted above-ground in a shearing/shredding device 28. The waste collection unit 16 supplies disposable waste to the shearing/shredding device 28. The shearing/shredding device 28 can, in an embodiment, be a shearing device only. In an alternative embodiment, the shearing/shredding device 28 is a shredding device only. In a second alternative embodiment, the shearing/shredding device 28 is a combination of a shearing device and a shredding device. By "shearing" is meant cutting the waste material such as discarded rubber tires into pieces that are relatively large. For example, a single tire can be sheared into three or four smaller pieces. By "shredding" is meant cutting the waste material such as discarded rubber tires into pieces that are relatively small. For example, a single tire can be shredded into hundreds or thousands of smaller pieces. It is also within the scope of the present invention to pulverize the waste material, especially discarded rubber tires, into millimeter-sized particles or even smaller. Of course, such a pulverization operation is extremely energy intensive.

Sheared/shredded tires are transported to an underground extrusion device 15 by means of a hollow waste pipe 17. In an alternative embodiment, the shearing or shredding operation is conducted underground in a shearing/shredding device (not shown) within the underground control center 9. In yet another alternative embodiment, both an above-ground first shearing/shredding device 28 and an underground second shearing/shredding device (not shown) are employed in the same mining operation. Larger pieces of tire, which escaped the shearing/shredding of the first shearing/shredding device 28, are sheared or shredded immediately before entering the underground extrusion device 15.

The extrusion device 15 advances behind the roof resin bolting machine 10. It extrudes waste material into the void space created by the removal of coal from the coal seam. In an embodiment, the extrusion of the waste material is in a continuous manner.

In an alternative embodiment of the present invention, the extrusion device 15 is a movable spraying device. The spraying device operates in a manner similar to a spray dryer, filling the void space with waste material. Preferably, the waste material is pulverized before entering the spraying device. In an embodiment, the spraying device operates in a manner such that the pulverized waste material is blown in the direction of the underground control center.

The process of the present invention provides a unique approach to the problem of storing waste material such as discarded rubber tires. All prior art methods for disposal of discarded rubber tires are energy intensive. The present process safely and efficiently transfers discarded rubber tires to the crust of the earth, preferably deep within the crust, where they can be recycled by natural means.

The movable extrusion device 15 is operatively connected to a second power source (not shown) wherein the second power source is operatively connected to the computerized control panel (not shown) by electrical means. Electric cables and wires can be employed as the electrical means. Mining personnel within the underground control center 9 operate the computerized control panel to advance the movable extrusion device 15.

The extrusion device 15 is operatively connected to an above-ground waste disposal unit 16 by means of a hollow transfer tubing 17. The waste disposal unit 16 is located on the surface of the earth adjacent to the entrance of the main shaft 6 of the coal mine. Preferably, the waste disposal unit 16 is located within 100 yards of the entrance to the main shaft 6 of the coal mine. Waste material suitable for burial in an underground mine is loaded into the waste disposal unit 16. It is within the scope of the present invention to compact the waste material. Thus, the waste disposal unit 16 can contain a compaction device (not shown) for compacting waste material. It is also within the scope of the present invention to shear or shred discarded rubber tires in the waste disposal unit 16 with a shearing/shredding device 28.

The above-ground waste disposal unit 16 is operatively connected to the extrusion device 15 by means of a hollow transfer tubing 17. Waste material, such as discarded rubber tires or the like, passes through the hollow transfer tubing 17 and directly into the movable extrusion device 15. In an alternative embodiment, the waste material passes through the hollow transfer tubing 17 and into the second shearing/shredding device (not shown). After being sheared or shredded in the second shearing/shredding device to obtain a sheared/shredded waste material, the material is transferred to the underground extrusion device 15. Waste material is deposited in underground mined out void space by the extrusion device 15. In a preferred embodiment, the extrusion device 15 operates in such a manner as to extrude the waste material in the direction of the underground control center.

It is within the scope of the present invention to conduct a dual mining operation wherein the method of the present invention is conducted in tandem with a traditional underground mining operation, such as long-wall mining. An underground control center is constructed in a seam of coal. In another area of the coal seam, miners work with traditional mining equipment in a ventilated region at the face of the coal seam. Mining personnel in the underground control center advance at least one drill head into a section of the coal seam. In an embodiment, that section is not occupied by miners working in a ventilated region.

In an embodiment, a traditional mining operation is retrofitted to obtain the mining operation of the present invention. A traditional mine, such as a mine employing long-wall mining technology, is retrofitted by a method comprising: (a) constructing an underground control center containing a computerized control panel; and (b) obtaining a drill head; a hollow, extendable drill shaft; and a power source. The hollow, extendable drill shaft operatively connects the drill head to the power source. The power source is operatively connected to the computerized control panel by electrical means. In an embodiment, the electrical means includes electric cables and/or wires. Mining personnel employ the computerized control panel within the underground control center to mine, collect and transfer coal. Only the underground control center is ventilated. In a preferred embodiment, a ventilation fan, a ventilation unit, and ventilation shaft are employed to provide fresh air to the underground control center, and to remove stale air.

The present invention relates to coal that is obtained by a process including locating an underground seam of coal; digging a mine shaft to reach the underground seam of coal; and constructing a control center substantially within the underground seam of coal. The control center comprises an overhead including a ceiling section and roof bolts, a plurality of walls depending from the overhead, and a floor section for receiving the plurality of walls. A computerized control panel is included inside of the underground control center. The underground control center is ventilated by employing a ventilation fan, a ventilation unit and ventilation shaft. Fresh air is supplied to the underground control center, and stale and polluted air is removed from the underground control center. The process further includes obtaining a drill head, a hollow drill shaft and a power source. The hollow drill shaft operatively connects the drill head to the power source. The power source is operatively connected to the computerized control panel by electrical means. Mining personnel enter the underground control center and operate the computerized control panel to drive the drill head into the seam of coal. Coal aggregate is obtained from the coal seam by the action of the drill head. The coal aggregate is recovered and transferred to the surface of the earth.

It is within the scope of the present invention to ventilate the mined out area of the coal seam. This can be necessary in cases such as equipment repair wherein the equipment cannot be retrieved back to the ventilated underground control center. In an alternative embodiment, mining personnel can advance through the mined out area of the coal seam in ventilated personnel carriers. In yet another alternative embodiment, the mining personnel can advance through the mined out area of the coal seam by employing individual breathing devices.

Coal gas and shale gas production are increasingly an important energy source for the United States. Annual coal bed methane production in the United States has increased significantly in the past ten years. Coal bed methane is thus an important energy source. A significant amount of natural gas produced from coal beds, carbonaceous shales and organic rich shales is secondary biogenic methane that formed under natural processes after burial, coalification and subsequent uplift and cooling. In both coal bed and shale reservoirs the majority of the gases are sorbed on the microporous matrix of the organic fraction of the rock. Relatively minor amounts of gas are sorbed on the inorganic part of the rock. The amount of gas sorbed to the organic, matter increases with increasing pressure until the surface of the organic matter is covered by a monolayer of gas molecules at which time no more gas can be sorbed to the organic matter. The coal or shale becomes saturated with respect to methane once the monolayer capacity has been reached. Methane is the dominant gas produced, but other gases including carbon dioxide, ethane, propane, butane, and hydrogen, as well as oil may be produced in varying proportions.

The present invention includes a method of recovering coal bed methane and shale gas from underground coal seams and underground shale deposits. The method of recovering gas from naturally existing subsurface formations of coal, carbonaceous shale or organic rich shales includes: locating the subsurface formation, digging a main shaft toward the subsurface formation wherein the main shaft extends into the formation; and constructing a ventilated underground control center within the subsurface formation. The underground control center is located substantially adjacent to the main shaft. The ventilated underground control center includes an overhead containing a ceiling section and roof bolts, a plurality of walls depending from the ceiling section, and a floor section for receiving the walls. The overhead, the plurality of walls and the floor section define a substantially airtight space. The control center further includes a computerized control panel.

The method further includes obtaining an extendable, rotatable, hollow drill shaft. The drill shaft has a proximal end and a distal end; and the drill shaft is operatively connected to the ventilated underground control center at its proximal end. A drill head is then obtained. The drill head is operatively connected to the drill shaft at the distal end of the drill shaft. A stationary power source is obtained. The power source is operatively connected to the computerized control panel by power source electrical means The power source is located adjacent to the ventilated underground control center. The power source is operatively connected to the drill head by means of the extendable, rotatable, hollow drill shaft.

The method further includes: constructing a stationary first hydraulic shield between the ventilated underground control center and the subsurface formation. The stationary first hydraulic shield is located substantially adjacent to the power source. A movable second hydraulic shield is obtained. The movable second hydraulic shield is located immediately behind the drill head.

The method further includes: obtaining a movable resin roof bolting machine; wherein the resin roof bolting machine is located behind the movable second hydraulic shield. The computerized control panel is operated by mining personnel to activate the power source and advance the drill head. The drill head bores into the subsurface formation.

The method further includes: obtaining an above-ground gas collection unit and a gas transfer pipe. The gas transfer pipe operatively connects the hollow drill shaft at the proximal end of the drill shaft to the above-ground gas collection unit. The hollow drill shaft collects gas from the subsurface formation. A pumping system can be employed to draw the gas from the subsurface formation and into the hollow drill shaft. The gas is transported from the hollow drill shaft to the above-ground gas collection unit. Again, a pumping system can be employed to draw the gas from the drill shaft and into the above-ground gas collection unit. The order of the apparatus located along the extendable, rotatable, hollow drill shaft beginning at its distal end is as follows: drill head, movable second hydraulic shield, movable resin roof bolting machine, stationary first hydraulic shield and stationary power source; and wherein the drill head, the movable second hydraulic shield and the movable resin roof bolting machine advance in unison into the subsurface formation when the power source is activated.

The method further includes: obtaining a movable extrusion device and positioning the extrusion device between the movable resin roof bolting machine and the stationary first hydraulic shield. The underground movable extrusion device is operatively connected to the second power source, which is operatively connected to the computerized control panel. Connecting means include electrical wires and electrical cables. An above-ground waste disposal unit is obtained. Waste material is added to the waste disposal unit. A hollow transfer tubing operatively connects the extrusion device to the waste disposal unit. Waste material is transferred from the above-ground waste disposal unit, through the hollow transfer tubing and into the underground movable extrusion device. Mining personnel located within the ventilated underground control center operate the computerized control panel to activate the movable extrusion device. Waste material is extruded into a mined out void space.

It is within the scope of the present invention to provide a coal mining operation in conjunction with a coal bed gas recovery operation. In an embodiment, a single ventilated underground control center is constructed after the digging of the mine shaft. A drill head and a hollow, extendable, rotatable drill shaft can be employed. In an embodiment, the interior of the drill shaft can be divided into concentric sections. The innermost section can transfer a coal slurry to the control center, and the outermost section can transfer coal bed gas to the control center. From the control center, the coal slurry and the coal bed gas are transferred to the respective above-ground collection units.

While the invention has been described by specific embodiments, there is no intent to limit the inventive concept except as set forth in the following claims.

We claim:

1. An apparatus comprising:

(a) an underground control center located within an underground coal seam, wherein the control center contains a computerized control panel;

(b) a hollow drill shaft, wherein the drill shaft is rotatable and extendable;

(c) a drill head;

(d) a power source, wherein the power source is operatively connected to the computerized control panel by electrical means; and wherein the power source is operatively connected to the drill head by the hollow drill shaft;

(e) an above-ground coal collection unit;

(f) an above-ground coal slurry pump house;

(g) a transfer means wherein the transfer means operatively connects the coal slurry pump house to the coal collection unit;

(h) a coal slurry pipe wherein the coal slurry pipe receives a coal slurry from the hollow, extendable drill shaft during a mining operation, and wherein the coal slurry pipe transfers the coal slurry to the above-ground coal slurry pump house;

(j) a ventilation fan wherein the ventilation fan is located on the surface of the earth;

(k) a ventilation unit wherein the ventilation unit is located inside the underground control center;

(l) a ventilation shaft wherein the ventilation shaft extends downwardly from the ventilation fan, and operatively connects the ventilation fan to the ventilation unit;

(m) a first stationary hydraulic shield wherein the stationary shield is located substantially adjacent to the underground control center;

(n) a second power source;

(o) a second movable hydraulic shield wherein the second movable hydraulic shield is located behind the drill head and wherein the second movable hydraulic shield is operatively connected to the second power source and wherein the second power source is operatively connected to the computerized control panel;

(p) a movable resin roof bolting machine wherein the resin roof bolting machine is operatively connected to the second power source and wherein the second power source is operatively connected to the computerized control panel; and (q) a movable extrusion device wherein the movable extrusion device is operatively connected to the second power source and wherein the second power source is operatively connected to the computerized control panel.

* * * * *